US008371752B2

(12) United States Patent
Heinemeier et al.

(10) Patent No.: US 8,371,752 B2
(45) **Date of Patent: *Feb. 12, 2013**

(54) PLASTIC BAG WITH OVERPRESSURE RELIEF

(75) Inventors: Jürgen Heinemeier, Kalefeld (DE); Burkhard Lückmann, Northeim (DE); Günther Reimann, Nörten-Hardenberg (DE)

(73) Assignees: Juergen Heinemeier, Kalefeld (DE); Burkhard Lueckmann, Northeim (DE); Guenter Reimann, Noerten-Hardenberg (DE)

( * ) Notice: Subject to any disclaimer, the term of this patent is extended or adjusted under 35 U.S.C. 154(b) by 37 days.

This patent is subject to a terminal disclaimer.

(21) Appl. No.: 13/038,458

(22) Filed: Mar. 2, 2011

(65) Prior Publication Data

US 2011/0188786 A1 Aug. 4, 2011

Related U.S. Application Data

(63) Continuation of application No. 11/138,641, filed on May 27, 2005, now Pat. No. 7,927,015.

(30) Foreign Application Priority Data

May 27, 2004 (EP) ..... 04012528

(51) Int. Cl.
*B65D 33/01* (2006.01)
*B65D 30/00* (2006.01)

(52) U.S. Cl. ..... 383/101; 383/107

(58) Field of Classification Search ..... 383/100–103, 383/107

See application file for complete search history.

(56) References Cited

U.S. PATENT DOCUMENTS 3,302,859 A 2/1967 Perry (Continued)

FOREIGN PATENT DOCUMENTS

CH 494169 A1 9/1970
DE 1212857 3/1966

(Continued)

OTHER PUBLICATIONS

Third Party Observations under Article 115 EPC relating to European patent application No. 04012528.8 (EP 1607339), dated May 17, 2007, 9 pages.

(Continued)

*Primary Examiner* — Jes F Pascua
(74) *Attorney, Agent, or Firm* — Norris McLaughlin & Marcus, P.A.

(57) ABSTRACT

A packaging container, including a flexible plastic wall with a region between an interior wall and exterior wall, the region being defined by at least one sealed or glued seam which is in at least a partial region selectively permeable to gas and has a reduced degree of bonding before sealing or gluing over at least said partial region. The region is formed by an overlap of a flat plastic web. The overlap is arranged between the two outer edges of the flat film. The at least one glued or sealed seam includes one or both of longitudinal seams. The interior wall includes at least one opening having a size sufficient to allow gas to escape from an interior portion of the container and to enter into the region between the interior and exterior walls. The at least one opening is located at a spaced distance from the at least one sealed or glued seam. At least one spacer is located between the at least one opening and the at least one sealed or glued seam.

18 Claims, 3 Drawing Sheets

U.S. PATENT DOCUMENTS

| | | | | |
|---|---|---|---|---|
| 3,309,006 | A | 3/1967 | Perry et al. | |
| 3,439,869 | A | 4/1969 | Shrum et al. | |
| 3,473,725 | A | 10/1969 | Wiehahn | |
| 3,785,547 | A | 1/1974 | DeVries | |
| 3,937,395 | A | 2/1976 | Lawes | |
| 4,550,441 | A | 10/1985 | Keppel | |
| 5,180,599 | A | 1/1993 | Feldmeier et al. | |
| 5,493,844 | A | 2/1996 | Combrink | |
| 5,553,942 | A | 9/1996 | Domke et al. | |
| 5,655,842 | A | 8/1997 | Hagino | |
| 5,701,996 | A | 12/1997 | Goto et al. | |
| 5,922,162 | A | 7/1999 | Brugger et al. | |
| 6,582,123 | B1 | 6/2003 | Tang | |
| 6,596,355 | B1 * | 7/2003 | Mita et al. | 428/35.2 |
| 6,984,067 | B2 | 1/2006 | Tokita | |
| 7,090,398 | B2 | 8/2006 | Shibata | |
| 7,927,015 | B2 * | 4/2011 | Heinemeier et al. | 383/101 |
| 2007/0181459 | A1 | 8/2007 | Lindlbauer | |
| 2009/0052813 | A1 | 2/2009 | Gross-Heitmeyer et al. | |

FOREIGN PATENT DOCUMENTS

| | | | |
|---|---|---|---|
| DE | 4303894 | A1 | 8/1994 |
| DE | 19538146 | A1 | 4/1997 |
| EP | 0444261 | B1 | 9/1991 |
| EP | 0144011 | B2 | 12/1992 |
| EP | 0768245 | A | 4/1997 |
| EP | 1422163 | A1 | 4/2004 |
| FR | 1367922 | | 7/1964 |
| GB | 1401713 | | 7/1975 |
| JP | 63212531 | A | 9/1988 |
| JP | 06171247 | A | 6/1994 |
| JP | 09156016 | A | 6/1997 |
| JP | 10114376 | A | 5/1998 |
| JP | 2002080070 | A | 3/2002 |
| JP | 2003054651 | A | 2/2003 |
| JP | 2004090261 | A | 3/2004 |
| JP | 2004115053 | A | 4/2004 |
| JP | 2004203423 | A | 7/2004 |
| WO | 2005092724 | A1 | 10/2005 |
| WO | 2007087965 | A1 | 8/2007 |

OTHER PUBLICATIONS

Email from Bischof + Klein to Dr. Jutta Wagner, Jul. 5, 2006, including attachments 101-0200_IMG.JPG, 102-0202_IMG.JPG, 102-0203_IMG.JPG, 102-0205_IMG.JPG, 102-0207_IMG.JPG, Spezi Für RKW.pdf, and Fert. auftrag RKW.pdf (11 pgs).

European Opposition to European Patent No. 1607339, dated Dec. 23, 2008.

Third Party Observations under Article 115 EPC relating to European patent application No. 04012528.8 (EP 1607336), dated May 17, 2007, 9 pages.

Observation by a Third party according to Article 115 EPC (EP04012528), Jun. 22, 2006, file by V.R. Driver (3 pgs).

Letter from Bischof + Klein to RKW AG and English Translation thereof, Apr. 28, 2006 (3 pgs).

* cited by examiner

PLASTIC BAG WITH OVERPRESSURE RELIEF

CROSS-REFERENCE TO RELATED PATENT APPLICATIONS

This application is a continuation application of application Ser. No. 11/138,641 filed on May 27, 2005 now U.S. Pat. No. 7,927,015. The prior application claims the right of foreign priority under 35 U.S.C. §119(a) based on EP 04 012 528.8 filed May 27, 2004, the entire contents of which, including the specification, drawings, claims and abstract, are incorporated herein by reference.

BACKGROUND OF THE INVENTION

The present invention relates to flexible packaging containers that are made of plastic.

Plastic packagings are characterized in that they are light, stable, relatively tight, more particularly watertight and airtight and, at the same time, cost-effective. For that reason, they are extensively used for the packaging of free-flowing solids in a great number of fields, such as, for example, in the chemical industry (granulates, etc.), in the gardening business (garden soil, fertilizers), and in the food trade.

For cost reasons, preferred use is made of so-called FFS tubes (Form-Fill-Seal). In this instance, the packaging container is made of a endless film web, in most cases immediately before the filling phase. The endless film web is either manufactured as a tube, or a tube is initially formed from a flat film or sheet by being folded over and sealed or glued in the longitudinal direction. The tube is delivered to the filling unit where a first sealed or glued transverse seam forms the bottom and, after the product has been filled in, the container is closed at its top by a second sealed or glued seam extending in the transverse direction.

When building materials which are often hygroscopic are packaged, the protection of the contents from moisture is of particular importance. On the other hand, such products are still very often filled in paper containers, because cement and similar materials, while and after they are filled, are particularly apt to develop an overpressure in the packaging. This overpressure may escape through paper, but remains inside the airtight type of plastic packaging, after these are closed and sealed.

To avoid these problems, it is a known practice to provide a valve in the bottom of so-called block bottom bags, with the overpressure being relieved through the valve during filling. For cost reasons, however, block bottom bags and, more particularly, block bottom bags with expensive and complicated valve designs are not preferred for comparatively low-cost products, such as building materials.

EP 444 261 describes flexible packaging containers in the form of a sack or bag where overpressure relief is achieved by means of perforations in a region of the container where the latter comprises two layers. To this end, perforations are provided both in the interior wall and the exterior wall, wherein the perforations in the exterior wall should have a smaller cross-sectional area than the perforations in the interior wall. Deflation is then achieved by an overpressure developing between the interior and exterior walls, such that the overpressure is intended to permit a controlled escape. The publication discloses that, when products are very fine, a filter is required between the interior and exterior walls, in order to prevent the product from escaping. Furthermore, these perforations, which are arranged immediately one above the other after the overpressure has been relieved, form an opening for entry of air, water and other contaminants.

There is, hence, still a demand for a low-cost packaging container that can, at the same time, reliably protect products from contamination and/or moisture when overpressure must be relieved during and/or after said products are filled in.

SUMMARY OF THE INVENTION

One object of the present invention is to provide an improved flexible packaging container.

Another object of the invention is to provide an improved flexible packaging container of the type in which an overpressure relief mechanism is included in the container.

According to one aspect of the present invention, there has been provided a packaging container, comprising: a flexible plastic wall which comprises a region having an interior wall and an exterior wall, this region being defined by means of at least one sealed or glued seam, wherein the interior wall comprises one or more openings having a size sufficient to allow gas to escape from an interior portion of the container and to enter into the region between the interior and exterior walls, wherein the at least one sealed or glued seam defining the region has in at least a partial region a reduced degree of bonding sufficient to allow gas to escape in response to a predetermined pressure.

According to another aspect of the invention, there has been provided a method for producing a packaging container, comprising: forming a tube from a web of plastic material by overlapping longitudinal edges of the web and forming two generally parallel glued or sealed seams in the overlapped edge region, to produce a flexible plastic wall which comprises a region having an interior wall and an exterior wall; forming in said interior wall one or more openings having a size sufficient to allow gas to escape from an interior portion of the container and to enter into the region between the interior and exterior walls; and forming at least one transverse glued or sealed seam intersecting said region, wherein at least one of said sealed or glued seam defining said region has, in at least a partial region, a reduced degree of bonding sufficient to allow gas to escape in response to a predetermined pressure.

Further objects, features and advantages of the present invention will become apparent from the detailed description of preferred embodiments that follows, when considered in conjunction with the accompanying figures of drawing.

BRIEF DESCRIPTION OF THE DRAWINGS

The present invention will be illustrated in more detail below by means of the accompanying figures, depicting an exemplary FFS packaging, without being restricted thereto. In the Figures.

DETAILED DESCRIPTION OF THE PREFERRED EMBODIMENTS

Figure 1:
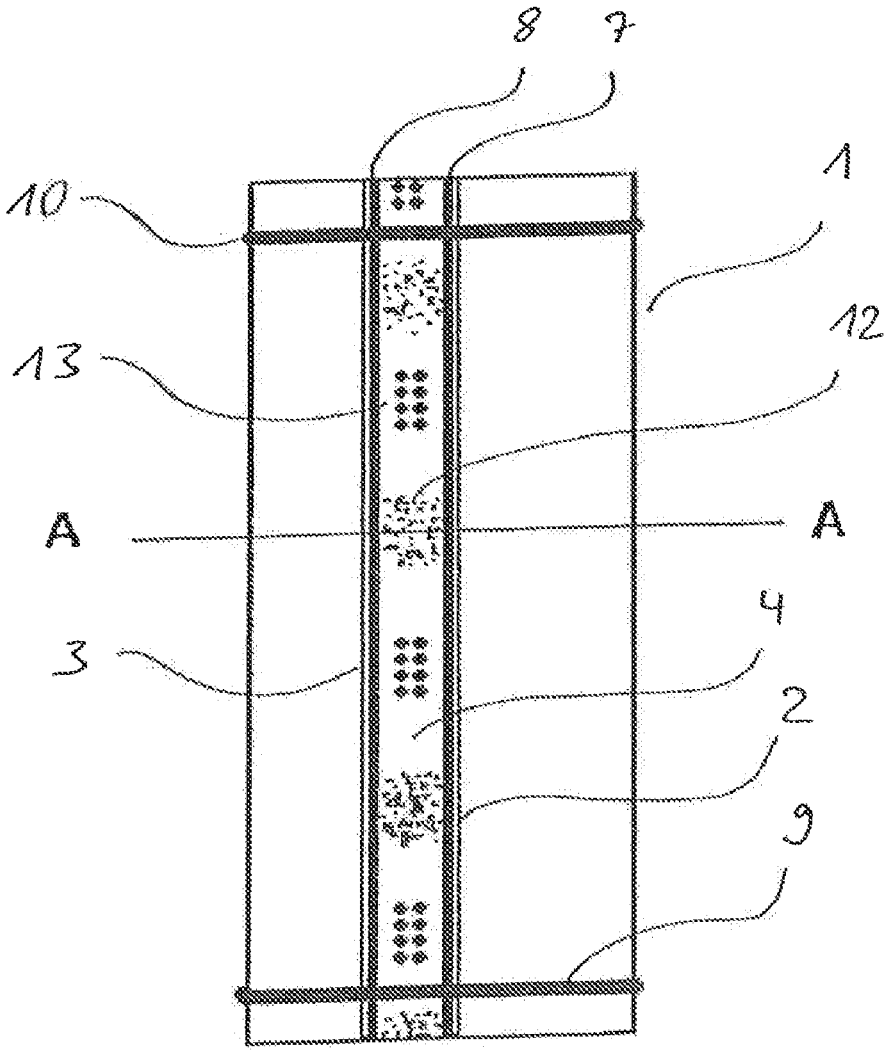
FIG. 1 is a plan view of an FFS packaging according to one embodiment of the invention.

A flexible packaging container according to the invention is made of plastic, wherein a region comprising an interior wall and an exterior wall is formed by means of a sealed or glued seam, such that the interior wall is provided with openings which allow gas to escape from the interior region of the container and to enter into the region between the interior and exterior walls. The sealed or glued seams enclosing this region allow gas to escape in at least a partial region. Surprisingly, it is possible to make the sealed or glued seam partially gas permeable without adversely affecting the stability of the container.

Packaging containers according to the invention are, among others, FFS tubes, block bags, open gusseted bags and/or flat sacks, valve sacks (glued and sealed), hexagonal bottom sacks, automatic machine (flat) films, etc. In particular, FFS packaging containers are preferred for low cost applications.

Furthermore, packaging containers which are manufactured from a flat film are particularly preferred. In the manufacture of such packaging containers, the film web is, between its outer edges, already provided with an overlap in the longitudinal direction, which can be used as the region between the interior and exterior walls. Hence, it is not necessary to form this region separately for the production of packaging containers according to the invention.

In the case of packaging containers for which the plastic film is directly manufactured as a tube, e.g., by extrusion and usually with subsequent blowing, the region between the interior and exterior walls can be formed as a separate step, e.g., by applying a separate film on the film that forms the packaging container, for example, by means of sealed or glued seams.

Preferably, one or both of the sealed or glued seams extending in the transverse direction is/are formed to be permeable to gas. If there is a sealed or glued seam extending in the longitudinal direction, it is also possible to form such a seam permeable to gas, either in whole or in part.

Preferably, gas permeability can be achieved by modifying the bonding properties of the surface of the film, either selectively at the spots to be connected, or entirely. This can be accomplished preferably, for example, by means of a separation medium or Corona treatment, with the result that the seam has a reduced strength. This is possible on one or more sides, over the entire surface or over a part of the surface only. Suitable separation media are all media preventing the plastic film from completely sealing or gluing, such as oils, greases, paints, lacquers, varnishes, powdery solids, or coatings of other agents that produce the desired effect. Of these, lacquers are preferred. The preferred lacquers have a polymeric binder and a solvent with a high vapor pressure. A pigment is not necessary for the invention, but may be present. Several preferred lacquers are WP74-076D from XSYS Print Solution, formerly BASF Drucksysteme, and RL 90 CK820-1 from Gebr. Schmidt. The binders in those lacquers are based on polyamide. Other lacquers or coating materials available from Hostmann+Steinberg (Celle); Institute Fresenius: Farben; Merkel Coatings (Gattendorf); Reicolor Chemie GmbH; Sicpa (Helsinki); and Sun Chemical (Niederhausen) may also be used.

The reduced strength of the seam ensures that the gas escapes in a controlled manner, thus relieving the overpressure that develops during or after filling. The use of filters or the like, which were necessary according to the state-of-the-art to prevent the product from escaping, is not necessary since the openings in the interior wall are covered by the tight exterior wall. Even the escape of very fine particles is practically impossible through the weakened seam. This can be attributed to the fact that the adhesive forces acting between the films, which are only in part firmly connected to each other, produce a certain degree of adhesion even without a securely sealed or glued connection. Further, only if the adhesive forces are overcome by a difference in pressure, such as the overpressure developing during or after filling, will the seam open and release said overpressure.

Contrary to the state-of the-art, neither expensive and/or complicated valve designs nor perforations of the exterior walls are, therefore, necessary.

The non-woven insert intended to retain product that might enter into the region between the interior and exterior walls is not necessary, either. Since the openings in the interior wall are spaced apart from the weakened seams—preferably, the openings are arranged in the longitudinal center of the container and the transverse seams are weakened the product is almost completely prevented from escaping, owing to the long distance. The same applies to contaminants possibly entering into the region between the interior and exterior walls from outside.

Preferably, the openings in the interior wall are perforations made by needling. But it is also possible to provide slits or other openings permitting gas penetration. Particularly where very fine product is concerned, the openings are, preferably, arranged such that the distance from the openings to the (partial) region of the seam, allowing the gas to escape, is as long as possible.

For that reason, a preferred embodiment comprises openings which are arranged centrally in the longitudinal direction, wherein the partial region allowing the gas to escape is formed in one or both of the transverse seams.

To further improve overpressure relief, in particular in case of stacked packaging containers, spacers can be provided between the interior and exterior walls. For example, embossings are one preferred type of spacer.

These spacers ensure that the gas escaping in the region between the interior and exterior walls reaches the weakened portions of the seams, even in those containers that are positioned at the bottom of the stack. Without spacers, the pressure of the upper containers might press the interior and exterior walls onto each other so strongly that the overpressure inside the container will either not reach the region between the interior and exterior walls or press pressure will not reach the weakened (partial) regions of the seam(s).

The packaging containers according to the invention are, in essence, manufactured in the same manner as containers which are not provided with overpressure relief. The only additional step required, before at least one seam is applied, is the surface treatment which ensures that the seam, during its future manufacture, will be permeable to gas at least in partial regions.

Turning now to the drawings, FIG. 1 shows an FFS tube 1 which is manufactured from a plastic film that has been folded in the longitudinal direction, such that a region 4 with an interior wall 5 and an exterior wall 6 (cf. FIG. 2) is formed between the two outer edges 2 and 3 of the film. Two sealed seams 7 and 8 extending in longitudinal direction fix the outer edges 2 and 3 of the film to the film arranged below or above it, with the result that a tube is formed. Before being filled, the packaging container is provided with a sealed seam 9, forming the bottom and, after having been filled, with a sealed seam 10, closing the packaging.

On the side to eventually face the interior region 14 of the packaging 1, the outer edge 2 of the film is provided with a release agent that enables the sealed seam 7 to selectively allow gas to escape. Furthermore, perforations 12 and, preferably, embossings 13 are applied along the outer edge 3 in the longitudinal direction.

Figure 2:
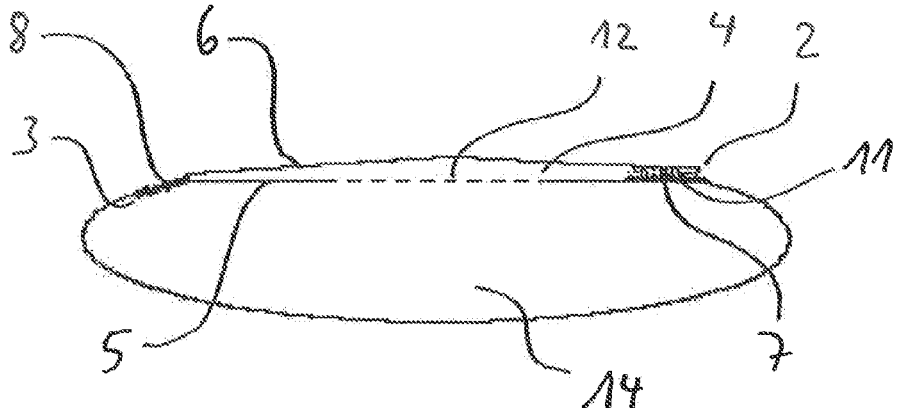
FIG. 2 is a sectional view taken from lines A-A in FIG. 1.

As can be seen from FIG. 2, the perforations 12 will be positioned in the interior wall of the region 4 after the film has been sealed to form a tube. This also applies to the optional embossings 13 which are, however, not shown in FIG. 2.

As soon as overpressure develops in the interior region 14 of the packaging 1, the gas will enter through the perforations 12 into the region 4 and will there be discharged to the outside through the sealed seam 7, that is selectively permeable to gas. Any penetration of product into the region 4 is harmless, since such product can hardly exit through the sealed seam. Neither must it be feared that contaminants might enter the interior region 14 since, after the overpressure has been relieved, the interior and exterior films are arranged tightly on top of each other, being fixed in this position by adhesive forces.

Hence, the packaging according to the invention even allows the packaging of cement-containing building materials which are hygroscopic and tend to develop overpressure after having been filled.

Figure 3:
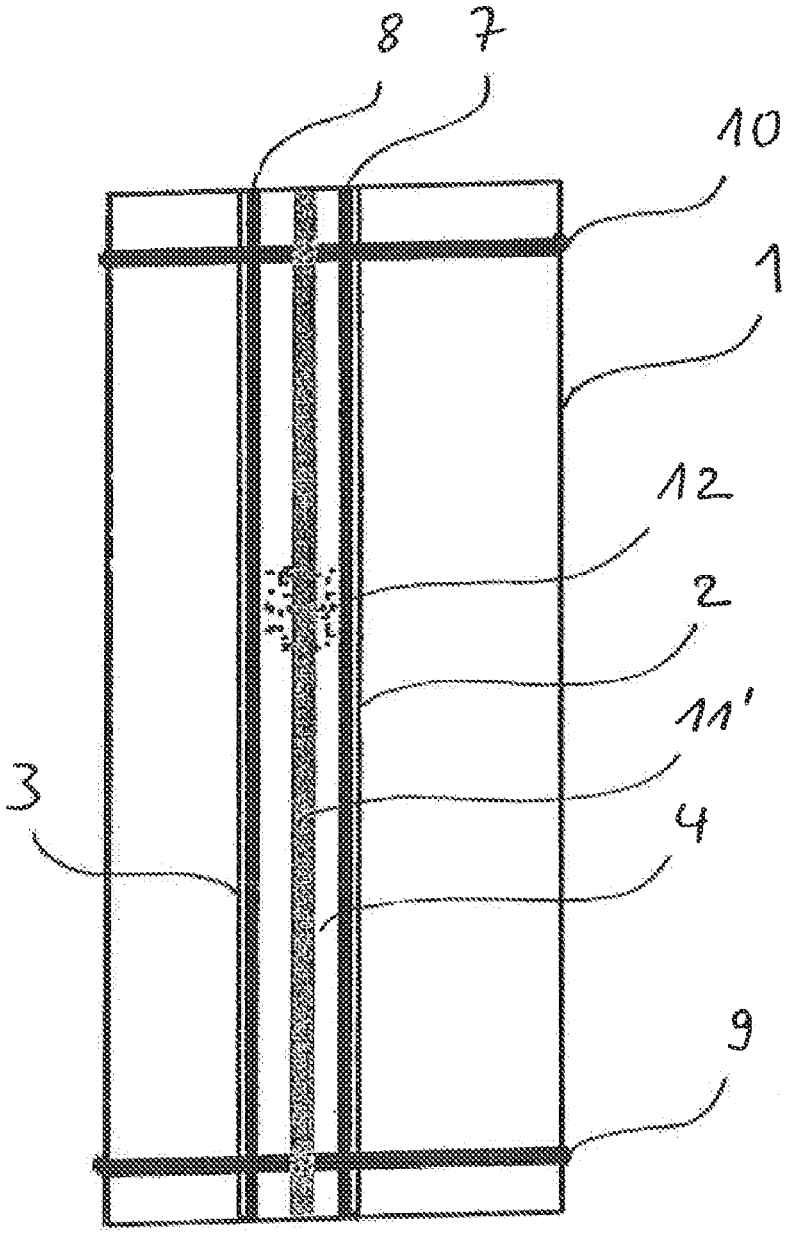
FIG. 3 is a plan view of a second embodiment according to the invention.

FIG. 3 shows an FFS packaging with an alternative seam ha is permeable to gas. The same reference numbers refer to identical parts.

FIG. 3 shows an FFS tube 1 where a region 11' that has been subjected to a Corona treatment is provided in place of the release agent. In this way, the transverse sealed seams 9 and 10 allow gas to escape in the region 11' in the presence of overpressure. The openings are formed as perforations 12 only in the center of the bag. Spacers are not provided in the illustrated embodiment, but can also be used if desired. This embodiment is particularly suited for very fine products, because the distance from the openings to the region where gas escapes is particularly long. Thus, the product can be prevented from escaping practically completely.

The foregoing description of preferred embodiments of the invention has been presented for purposes of illustration and description only. It is not intended to be exhaustive or to limit the invention to the precise form disclosed, and modifications and variations are possible and/or would be apparent in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto and that the claims encompass all embodiments of the invention, including the disclosed embodiments and their equivalents.

What is claimed is:

1. A packaging container, comprising:

a flexible plastic wall which comprises a region between an interior wall and an exterior wall, said region being defined by at least one sealed or glued seam which is in at least a partial region selectively permeable to gas and has a reduced degree of bonding before sealing or gluing over at least said partial region, said region being formed by an overlap of a flat plastic web used to manufacture said packaging container, said overlap being arranged between two outer edges of the flat web, wherein said at least one glued or sealed seam comprises one or both of longitudinal seams, wherein the interior wall comprises at least one opening having a size sufficient to allow gas to escape from an interior portion of the container and to enter into the region between the interior and exterior walls, and wherein said at least one opening is located at a spaced distance from said at least one sealed or glued seam, further comprising at least one spacer located between said at least one opening and said at least one sealed or glued seam.

2. A packaging container according to claim 1, wherein said at least one opening comprises plural perforations.

3. A packaging container according to claim 2, further comprising at least embossing serving as the spacer positioned between said plural perforations and said at least one sealed or glued seam.

4. A packaging container according to claim 1, wherein the packaging container is selected from the group consisting of an FFS tube, a block bag, an open gusseted bag, a flat sack, a valve sack and a hexagonal bottom sack.

5. A packaging container according to claim 4, wherein the packaging container comprises an FFS packaging.

6. A packaging container according to claim 1, wherein the at least one sealed or glued seam has its degree of bonding reduced by a separation medium applied, on one side or both sides, to the plastic before sealing or gluing, over at least a part of the surface to be sealed or glued.

7. A packaging container according to claim 1, wherein the at least one sealed or glued seam has its degree of bonding reduced by being subjected to a Corona treatment, on one side or both sides, to the plastic before sealing or gluing, over at least a part of the surface to be sealed or glued.

8. A packaging container according to claim 1, wherein said spacer comprises at least one embossing formed in the plastic wall.

9. A packaging container according to claim 1, wherein said at least one opening is located as far as possible from said at least one sealed or glued seam.

10. A packaging container according to claim 1, wherein the container does not include a filter or a non-woven insert.

11. A packaging container, comprising:

a flexible plastic wall which comprises a region between an interior wall and an exterior wall, said region being defined by two transverse sealed seams and by at least one sealed or glued longitudinal seam and being in at least a partial region selectively permeable to gas, wherein the interior wall comprises at least one opening having a size sufficient to allow gas to escape from an interior portion of the container and to enter into the region between the interior and exterior walls, and at least one spacer located between said at least one opening and said at least one sealed or glued longitudinal seam, wherein said at least one sealed or glued longitudinal seam has a reduced degree of bonding by a separation medium applied, on one side or both sides, to the plastic before sealing or gluing over at least said partial region.

12. A packaging container, comprising:

a flexible plastic wall which comprises a region between an interior wall and an exterior wall, said region being defined by two transverse sealed seams and by at least one sealed or glued longitudinal seam and being in at least a partial region selectively permeable to gas, wherein the interior wall comprises at least one opening having a size sufficient to allow gas to escape from an interior portion of the container and to enter into the region between the interior and exterior walls, and at least one spacer located between said at least one opening and said at least one sealed or glued seam, wherein said at least one sealed or glued longitudinal seam has a reduced degree of bonding by being subject to a Corona treatment on one side or both sides, to the plastic before sealing over at least said partial region.

13. A method for producing a packaging container, comprising:

forming a tube from a web of plastic material by overlapping longitudinal edges of the web;

forming two generally parallel glued or sealed longitudinal seams in the overlapped edge region, to produce a flexible plastic wall which comprises a region between an interior wall and an exterior wall;

forming in said interior wall one or more openings having a size sufficient to allow gas to escape from an interior portion of the container and to enter into the region between the interior and exterior walls; and forming at least one transverse glued or sealed seam, wherein said at least one sealed or glued longitudinal seam defining said region is in at least a partial region selectively permeable to gas, and wherein at least one of said sealed or glued longitudinal seam has a reduced degree of bonding to the plastic before sealing or gluing over at least said partial region.

14. The method of claim 13, wherein said reduced degree of bonding is attained by a separation medium applied, on one side or both sides, to the plastic before sealing or gluing over at least said partial region.

15. The method of claim 13, wherein said reduced degree of bonding is attained by being subjected to a Corona treatment, on one side or both sides.

16. A method for producing a packaging container, comprising:

forming a plastic film as a tube and applying a separate film on the plastic film with longitudinal edges;

forming two generally parallel glued or sealed seams in the overlapped edge region, to produce a flexible plastic wall which comprises a region between an interior wall and an exterior wall;

forming in said interior wall at least one opening having a size sufficient to allow gas to escape from an interior portion of the container and to enter into the region between the interior and exterior walls; and forming at least one transverse sealed seam, wherein said at least one sealed or glued longitudinal seam defining said region is in at least a partial region selectively permeable to gas, and wherein at least one of said sealed or glued longitudinal seam has a reduced degree of bonding to the plastic before sealing or gluing over at least said partial region.

17. The method of claim 16, wherein said reduced degree of bonding is attained by a separation medium applied, on one side or both sides, to the plastic before sealing or gluing over at least said partial region.

18. The method of claim 16, wherein said reduced degree of bonding is attained by being subjected to a Corona treatment, on one side or both sides.

* * * * *